US005450805A

United States Patent [19]

Beach et al.

[11] Patent Number: 5,450,805

[45] Date of Patent: Sep. 19, 1995

[54] WARHEAD INFLUENCE

[75] Inventors: Eugene H. Beach; Armand Cioccio, both of Silver Spring; Earl A. Schuchard, Laurel, all of Md.

[73] Assignee: The United States of America as represented by the Secretary of the Navy, Washington, D.C.

[21] Appl. No.: 154,241

[22] Filed: Jun. 14, 1971

[51] Int. Cl.[6] ..... F42B 19/00; F42B 22/04; F42C 13/08

[52] U.S. Cl. ..... 114/20.1; 114/21.1; 114/21.2; 102/417; 102/418; 102/419; 102/427; 102/212; 102/214

[58] Field of Search ..... 114/20 R, 21 A, 21 R, 114/240, 20.1, 21.1, 21.2; 102/18, 19.2, 70.2 R, 70.2 P, 417–419, 427, 211, 212, 214; 324/40

[56] References Cited

U.S. PATENT DOCUMENTS 2,861,254 11/1958 Abrams et al. ..... 114/20 RU X
2,993,440 7/1961 Chubb et al. ..... 102/70.2 P X
3,016,513 1/1962 Van Dyke ..... 114/20 X
3,076,191 1/1963 Williams ..... 102/70.2 PU X
3,136,944 6/1964 Hafner ..... 102/70.2 P X
3,332,077 7/1967 Nard et al. ..... 102/70.2 P X
4,210,083 7/1980 Ream ..... 102/417
4,218,975 8/1980 Ream ..... 102/417

*Primary Examiner*—Charles T. Jordan
*Assistant Examiner*—Theresa M. Wesson
*Attorney, Agent, or Firm*—Jacob Shuster

[57] ABSTRACT

An active electromagnetic influence firing system has transmitter coils and receiver coils mounted on a single warhead section. One set of receiver coils has vertical look capability for detecting surface ships and another set has 360° look capability for detecting submarines. An influence electronics package automatically nulls out directly induced electromagnetic radiation and passes only the signature received from targets. Amplitude, duration, and frequency criteria implemented by circuitry in the influence electronics package determine whether there is a valid target.

8 Claims, 5 Drawing Sheets

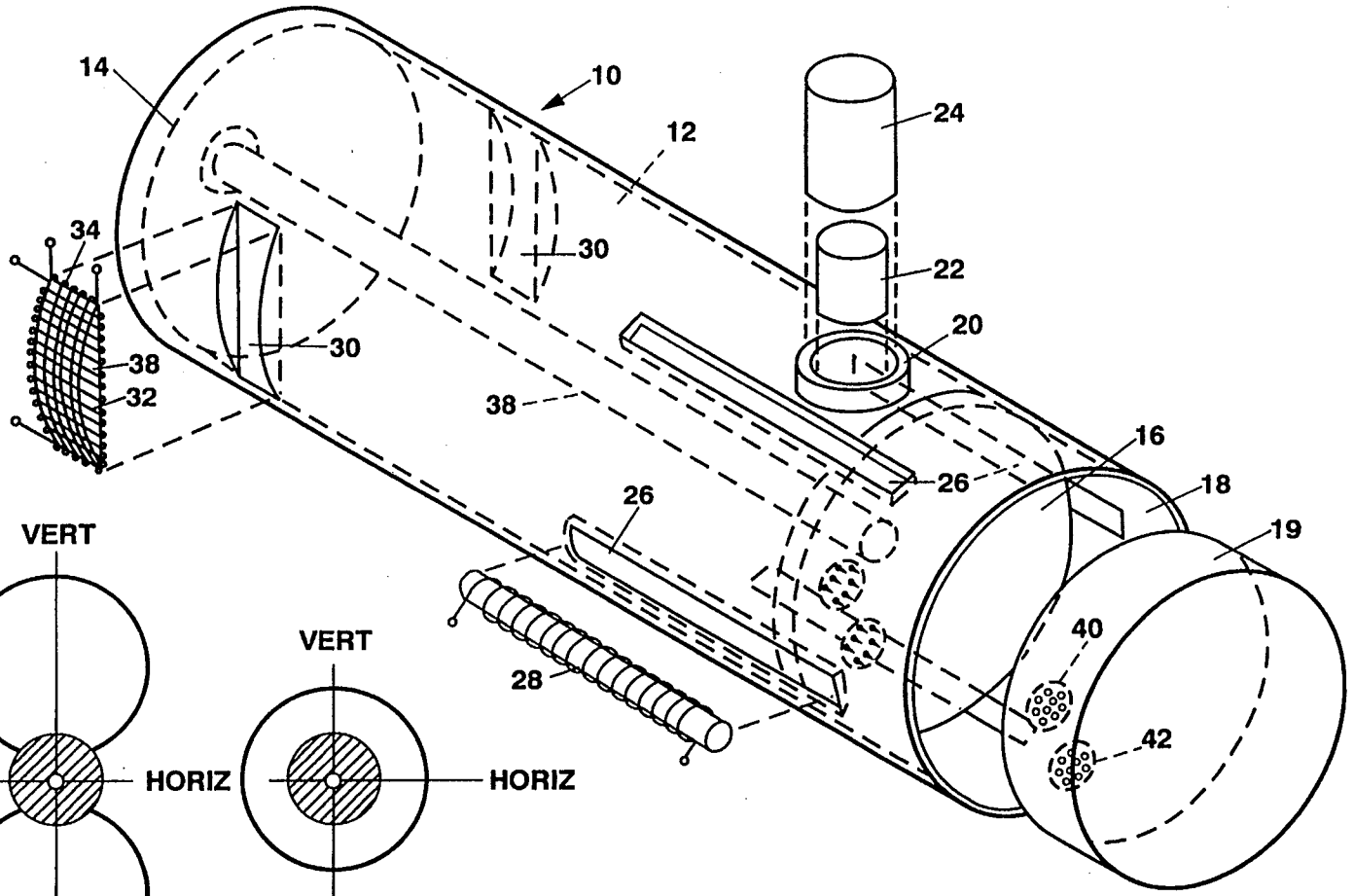
FIG. 1
FIG. 3B
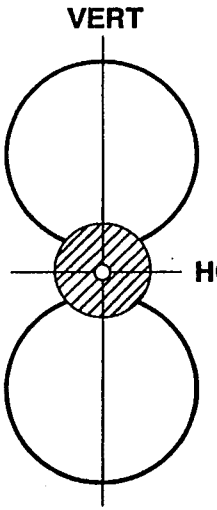
FIG. 3A

WARHEAD INFLUENCE

BACKGROUND OF THE INVENTION

This invention relates generally to a warhead exploder influence system, and more particularly to a torpedo exploder firing system for use against surface and submarine targets.

A variety of electromagnetic warhead influence firing systems have been developed for use in torpedos. These systems are divided into two major classes, the "RXE" and "RXEO" systems. The "RXE" design is characterized by orthogonal, internally mounted source and sensor coils, and envelope detection is used to amplify sensor signals. Sensor null balance is achieved by adjusting the sensor coil position and by manually adjusting an "in-phase" and a "quadrature" control within the warhead system. The sensitivity pattern produced by orthogonal source and sensor coils is highly directive, being sensitive above and below the torpedo and insensitive forward and abeam of the torpedo. This directivity pattern is effective against surface ships but results in an intolerable variation in firing range on collision course trajectories when used against a submarine target.

The RXEO design is subdivided into two classes, the "RXEO vertical look" and "RXEO 360° look" systems. The "RXEO vertical look" system incorporates surface mounted transmitter coils in the torpedo afterbody, while the sensor coils are placed in a plastic nose section. The large distance between the source and sensor coils minimizes the direct induced voltages. However, to achieve sensor null in this system, it is necessary to manually adjust the position of the sensor coils and to operate "in-phase" and "quadrature" controls. This system only has vertical look capabilities, and is therefore unsuitable for use against submarine targets. The "RXEO 360° look" system exhibits a sensitivity pattern that is constant about the torpedo roll or longitudinal axis with a maximum sensitivity along that axis. The 360° look pattern is achieved by placing the sensitive axis of the nose mounted sensor coil in line with the transmitter coil axis in a co-linear geometry. The source coils are surfaced mounted in the torpedo afterbody, while the receiving coil is mounted in the plastic nose section. Nulling is obtained by driving an opposite-polarity field from a small coil placed near the sensor coil which carries a portion of the transmitter coil current. In addition, an adjustable position metal plate, brass or steel, is located near the sensor coil to provide a "quadrature" null adjustment. This system suffers, however, from unresolved sea water unbalance problems, and delay in the generation of influence signatures as the torpedo passes under the rail of the target. Since the transmitter coils and receiver coils of the RXEO system are in two different sections of the torpedo, the system suffers from noise and alignment problems. In addition, these sections are not readily interchangeable, since it is necessary to re-align the coil configuration.

Since the receiver coils of the prior art system are mounted internally in the torpedo sections, it is necessary to make the shells out of material that does not greatly attenuate the returning signal generated by the target. Consequently, non-attenuating materials such as plastic, fiberglass, or titanium must be used in the receiver section which greatly add to the cost of the torpedo.

Neither of the prior art systems is capable of operating against both submarine and surface targets. Furthermore, the excessive noises in both systems produced by alignment problems prevent firing at the optimal stand-off range. Consequently, the explosive charge is not used to its optimum capability.

SUMMARY OF THE INVENTION

Accordingly, an object of the present invention is to provide a new and improved warhead influence firing system.

Another object of the present invention is to provide an active electromagnetic warhead influence firing system that optimizes explosive charge versus effective stand-off range.

Still another object of the present invention is to provide a warhead influence firing system for use against surface ships and submarines targets.

A further object of the present invention is to provide a unique warhead system componential arrangment utilizing a single torpedo section.

A still further object of the present invention is to provide a novel array of coils mounted externally on the torpedo section.

An additional object of the present invention is to provide a warhead influence firing system that is readily interchangeable and requires no pre-launch adjustments.

Briefly, in accordance with one embodiment of this invention, these and other objects are obtained by providing an influence warhead firing system having externally mounted transmitter and receiver coils, wherein separate receiver coils are used for both vertical look and 360° look. An influence electronics package automatically nulls out directly induced transmitter signals and processes signals received from a target to determine when a fire signal should be generated.

BRIEF DESCRIPTION OF THE DRAWINGS

FIG. 1 is an exploded pictorial view of the warhead section, including the transmit and receive coils;

FIG. 3 (*a*) is a view of the vertical look receiver pattern along the longitudinal axis of the torpedo;

FIG. 3 (*b*) is a view of the 360° receiver pattern along the longitudinal axis of the torpedo;

DESCRIPTION OF THE PREFERRED EMBODIMENT

Figure 2:
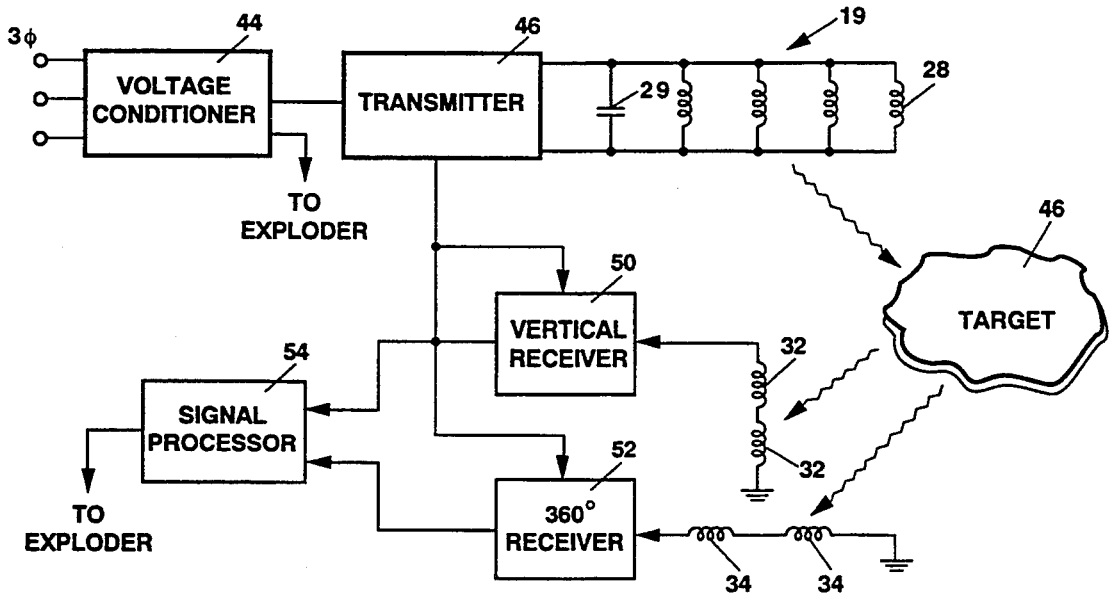
FIG. 2 is a block diagrammatic view of the influence electronics package of the present invention.

Referring now to the drawings wherein like reference characters designate identical or corresponding parts throughout the several views, and more particularly to FIG. 1 which illustrates a warhead section 10 that contains the electromagnetic influence firing system of the present invention. A cavity 12, defined by the warhead casing between bulkheads 14 and 16 contains section 10 and the back side of bulkhead 16 houses an influence electronics package 19 to be described more fully hereinafter. A well 20 in torpedo section 10 is used to hold a conventional arming device 22, such as the Mark 2 Mod 3 Arming Device, and a conventional exploder 24, such as the Mark 21 Exploder. Four elongate transmitter coil pockets 26 are located symmetrically about the shell of torpedo section 10, aligned parallel to the longitudinal axis of the torpedo. Each pocket 26 contains a transmitter coil 28, which is a bar coil wound on a ferromagnetic core. The leads from each transmitter coil 28 are connected to influence electronics package 19 as described hereinafter. Two receiver coil pockets 30 are formed diammetrically opposed on the surface of the torpedo section 10, longitudinally displaced from transmitter coil pockets 26. Each receiver coil pocket 30 contains a pair of receiver coils 32 and 34 wound on a single ferromagnetic core 36. Receiver coils 32 and 34 are wound orthogonally to each other, so that with receiver coil pockets 30 lying in the horizontal plane of the torpedo, coil 32 is wound in the horizontal plane and coil 34 is wound in the vertical plane, for reasons more fully described hereinafter. The leads from receiver coils 32 and 34 are connected to the influence electronics package contained in cavity 18, and connected as described hereinafter. A communicating tube 38 is positioned longitudinally in cavity 12, and is used for torpedo cabling. Through it pass power and control signals from the other sections of the torpedo, which do not form part of this invention.

Influence electronics package 19 interfaces with the torpedo guidance and control system, which is not part of this invention, transmitting coils 28, receiving coils 32 and 34, and exploder 24. The influence firing system receives three-phase AC electrical power, arming mode, and stand-off range control signals from the guidance and control section of the torpedo through two multicontact electrical connectors 40 and 42. Referring now to FIG. 2 which illustrates influence package 19, the interface signals from the torpedo guidance and control systems are generated in a sequential order as the torpedo closes on the target. When the torpedo achieves sufficient speed to provide the required three-phase AC voltage, a conventional voltage conditioner 44 conditions the AC three-phase voltage to the proper regulated DC potential for the remaining circuitry of influence electronics package 19 and exploder 24. The output of voltage conditioner 44 is applied to a conventional transmitter 46 which generates an audio frequency sinusoidal signal. This audio frequency signal is applied to transmitter coils 28 which are connected in parallel. A capacitor 29 is connected in parallel with transmitter coils 28 that enables self-resonance. An electromagnetic field is radiated from transmitter coils 28. If this electromagnetic signal strikes a metallic object, such as the hull of a surface ship or torpedo, AC eddy currents are induced in the target at the same frequency as the transmitted electromagnetic radiation. These AC eddy currents generate their own electromagnetic field which is radiated away from target 48. If the torpedo is within a specified detection range, the electromagnetic signals generated by the eddy currents in target 48 are received by either receiver coils 32 or 34 or by both, depending upon which receiver coil directivity pattern the target 48 lies within. The directivity pattern for receiver coils 32 is illustrated in FIG. 3(*a*), and the directivity pattern for receiver coils 34 is illustrated in FIG. 3(*b*). In both FIGS. 3(*a*) and 3(*b*) the view is looking down the boresight or longitudinal axis of the torpedo. As seen from FIG. 3 (*a*), receiver coils 32 provide a figure-8 pattern which has maximum sensitivity along the vertical axis of the torpedo, and minimum sensitivity along the horizontal axis of the torpedo. Therefore, coils 32 provide a vertical look capability for the influence firing system which is necessary for detecting surface ships. As seen in FIG. 3 (*b*), receiver coils 34 provide a directivity pattern that is symmetrical about 360° of the longitudinal axis of the torpedo. This pattern is used in the detection of submarine targets.

Referring again to FIG. 2, the electromagnetic radiations from target 48 are picked up by either receiver coils 32 or 34 or both, depending upon the position of target 48 with respect to directivity pattern of the receiver coils. If the signal is picked up by receiver coils 32, it is fed to a vertical receiver 50 where it is processed, as more fully described hereinafter. If the signal is received by coils 34, it is applied to a 360° receiver 52 where it is processed, as more fully described hereinafter. The outputs of vertical receiver 50 and 360° receiver 52 are fed to a signal processor 54, more fully described hereinafter. If the signals received from target 48 satisfy frequency, amplitude, and duration criteria, as more fully described hereinafter, a signal is generated which is fed to exploder 24. If the torpedo has been satisfactorily armed by arming device 22, exploder 24 generates a firing signal which detonates the explosive in cavity 12.

Figure 4:
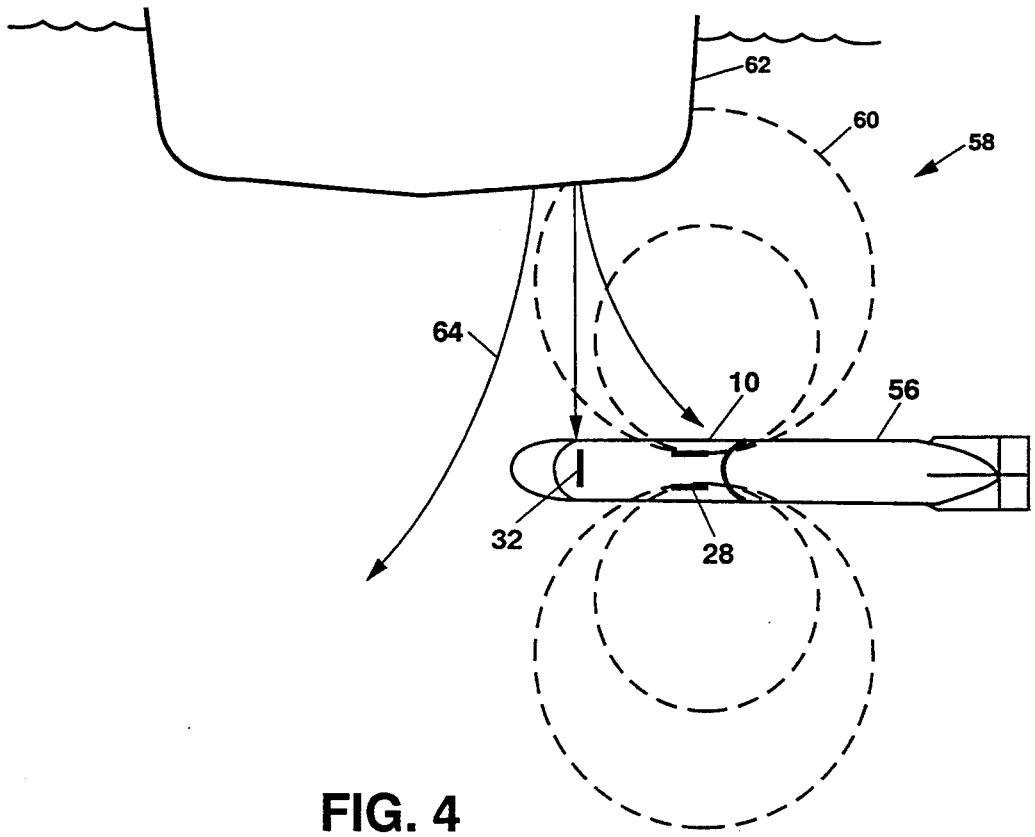
FIG. 4 is a pictorial view of a transmit pattern from the torpedo striking a hull of a surface ship, which, in turn, generates its own electromagnetic field that is received by the receiver coils.

FIG. 4 illustrates pictorially the operation of the active influence system for a surface ship. A torpedo 56 containing the influence firing system of the present invention in warhead section 10 is in a water medium 58. Transmitter coils 28 generate an electromagnetic field, indicated by field lines 60 which strike the metallic hull of a surface ship 62. The electromagnetic field 60 generates eddy currents in hull 62 which produce an electromagnetic radiation, indicated by field lines 64. This induced magnetic field is detected by vertical look receiver coils 32 when the torpedo is within detection range, indicating to the torpedo detection circuitry that a target has been acquired.

A large directly induced voltage is produced in receiver coils 34 by transmitter coils 28, since both sets of coils are aligned parallel. This large directly induced signal is hulled out by 360° receiver 52. In addition, this large directly induced voltage is reduced by having a small number of turns on receiver coils 34, for example 400 turns. Of course, by having a small number of turns on receiver coils 34 the detection range is also reduced. For example, the detection range for the 360° receiver pattern may be only a few feet. On the other hand, vertical look coils 32 are wound orthogonally to transmitter coils 28. Consequently, they receive very little voltage. Ideally, receiver coils 32 receive zero directly induced voltage from transmitter coils 28, but due to difficulty in having receiver coils 32 aligned exactly orthogonal to transmitter coil 28, there is a small residual directly induced voltage. For example, the directly induced signal in receiver coils 32 may be 80db down from the transmitted signal in transmitter coils 28. Since the directly induced voltage in receiver coils 32 is small, a large number of turns can be used with a corresponding increase in detection range. For example coils 32 may have five thousand turns each, with a detection range several times greater than the detection range of receiver coils 34. Since transmitter coils 28 and receiver coils 32 and 34 are mounted on the surface of torpedo section 10, the shell of torpedo section 10 can be made of a material that attentuates electromagnetic radiation. Accordingly, the shell of torpedo section 10 in the present embodiment is made of aluminum. In addition to a tremendous cost saving over other materials, the aluminum shell of the present invention provides a magnetic shield which prevents electromagnetic radiation from reaching the explosive charge contained in cavity 12. Consequently, the possibility of currents being generated within cavity 12 by electromagnetic radiation, which would heat the charge and possibly cause it to be set off, is eliminated. Additionally, by placing the transmitter and receiver coils on the surface of an aluminum shell, the eddy currents generated on the outer surface of the shell produce fields which add to the transmitted and received fields, thereby providing an amplification factor for the system. Typically, a gain of 1.4 is achieved over systems not having an electrically conducting shell.

Figure 5:
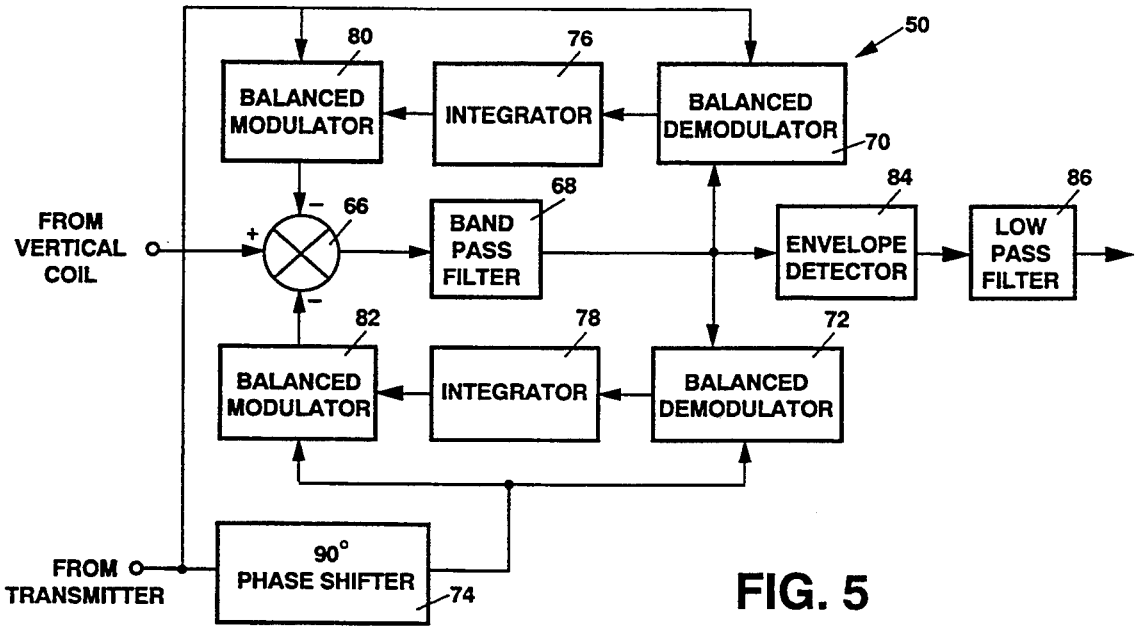
FIG. 5 is a block diagrammatic view of the vertical receiver of FIG. 2.

FIG. 5 illustrates vertical receiver 50. When there is no target within detection range of the electromagnetic influence system, receiver coils 32 produce a quiescent background signal, primarily due to the directly induced voltages from transmitter coils 28. When the torpedo passes within its detection range of a target, however, the electromagnetic signals produced by the target generate a transient voltage in receiver coils 32. It is the purpose of vertical receiver 50 to discriminate between the quiescent background signals and the transient target signals. It accomplishes this purpose by automatically nulling out the directly induced transmitted signals and by passing the signature generated by the target. The signals received by vertical coils 32 are applied to a conventional summing network 66. These signals contain directly induced voltages from transmitter coils 28 that may be out-of-phase with the carrier signal from transmitter 46, due to the spacing between transmitter coils 28 and vertical receiver coils 32, and the inductive effects of receiver coils 32. In addition, the induced voltages in receiver coils 32 may contain signals from target 48. Vertical receiver 50 breaks up the voltages in receiver coils 32 into components that are in-phase with the signal from transmitter 46 and 90° out-of-phase with the signals from transmitter 46. It then filters out the signals caused by target 48, thereby leaving only the components of the directly induced voltages from transmitter coils 28. These components are then subtracted from the signals from receiver coils 32 in summing network 66, thereby effectively nulling out the directly induced signals from transmitter coils 28.

The output signal from summing network 66 is fed to a conventional bandpass filter 68, having a narrow band width and a center frequency equal to the transmitted carrier frequency. The output of bandpass filter 68 is applied simultaneously to a pair of conventional balanced demodulators 70 and 72. Balanced demodulator 70 is driven by the carrier signal from transmitter 46, while balanced demodulator 72 is driven by the carrier signal from transmitter 46 phased shifted by 90° in a conventional phase shifter 74. Thus, balanced demodulators 70 and 72 break the signals from receiver coils 32 into in-phase and 90° out-of-phase components. The output of balanced demodulators 70 and 72 are fed, respectively, to conventional integrators 76 and 78. Integrators 76 and 78 may be, for example, low pass filters. The purpose of integrators 76 and 78 is to filter out signals induced by target 48. With no target present, there will be a fairly constant level of directly induced signals from transmitter coils 28 resulting in nearly constant outputs from balanced demodulators 70 and 72. These demodulated outputs, being of very low frequency, are passed by integrators 76 and 78. Signals from a target, however, cause an abrupt change in the level of output signals received by coils 32. This change is of too high a frequency to be passed by integrators 76 and 78, so it does not affect the operation of the nulling circuits. The outputs of integrators 76 and 78 are applied, respectively, to conventional balanced modulators 80 and 82. Balanced modulator 80 is driven by the carrier signal from transmitter 46, while balanced modulator 82 is driven by the output of phase shifter 74. Thus, the output of balanced modulator 80 is equal to the component of the directly induced signal received by coils 32 that is in-phase with the carrier signal from transmitter 46, while the output of balanced modulator 82 is equal to the component of the directly induced signal that is 90° out-of-phase with the carrier signal from transmitter 46. These two signals are subtracted in summing network 66 from the signals received by coils 32, thereby effectively nulling out the directly induced voltages from transmitter coils 28.

The output of bandpass filter 68 is fed to a conventional envelope detector 84. The output of envelope detector 84, representing the signature of the target, is applied to a conventional low pass filter 86 having a very low cutoff frequency, for example, 3 Hz. Since the directivity pattern of receiver coils 32 is aligned along the vertical axis of the torpedo, target acquisition in this mode will generally occur when the torpedo is either below or above the target. Consequently, high frequency return signals generated from collision course trajectories are blocked by low pass filter 86. The output of low pass filter 86 is then applied to signal processor 54, as described hereinafter. The 360° receiver 52 operates in substantially the same manner as vertical receiver 50. It differs only in that its bandpass filter corresponding to bandpass filter 58 has a wider bandwidth, its integrators corresponding to integrators 76 and 78 have a shorter time constant, and its low pass filter corresponding to low pass filter 86 has a much higher frequency cutoff point, for example, 20 Hz. Consequently, 360° receiver 52 passes higher frequency signals characterisitic of collision course trajectories between the torpedo and target 48.

Figure 6:
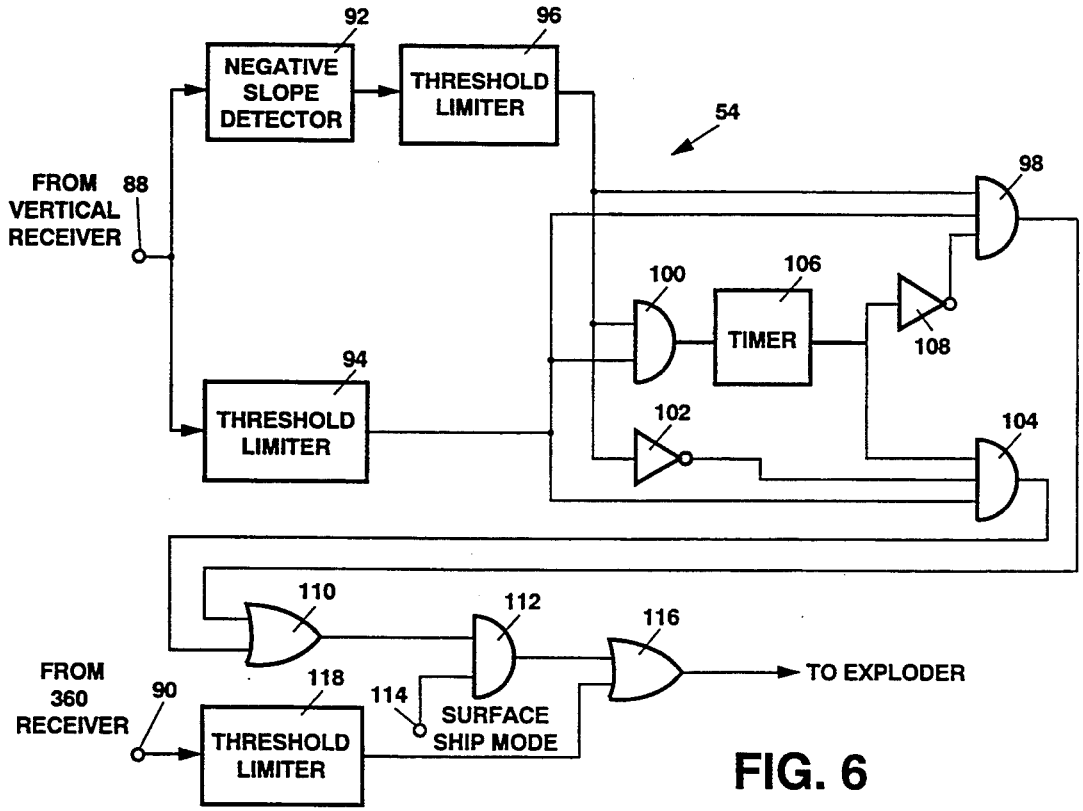
FIG. 6 is a block diagrammatic view of the signal processor of FIG. 2.

FIG. 6 illustrates the signal processor 54 of the present invention. The purpose of signal processor 54 is to determine whether the output of envelope 84 is a valid target signature. The output from low pass filter 86 of vertical receiver 50 is applied to an input terminal 88. The output from the low pass filter of 360° receiver 52 corresponding to low pass filter 86 is applied to an input terminal 90. The input signal at terminal 88 is fed simultaneously to a conventional negative slope detector 92 and a conventional threshold detector 94 connected in parallel therewith. If the input signal has a negative time derivative or slope, negative slope detector 92 will generate an output signal which is fed to a conventional threshold limiter 96. If the output of negative slope detector 92 is above a minimum level, threshold limiter 96 will produce an output signal corresponding to binary "1". The output from threshold limiter 96 is applied simultaneously to two AND gates 98, and 100 and an inverter 102. Threshold limiter 94 produces an output signal corresponding to a binary "1" if the signal from vertical receiver 50 is above a minimum threshold amplitude. The output from threshold limiter 94 is applied simultaneously to AND gates 98 and 100, and an AND gate 104. If threshold limiters 94 and 96 simultaneously produce outputs, indicating that the signal from vertical receiver 50 is both above a minimum threshold level and has a negative slope, AND gate 100 will generate an output corresponding to binary "1". This output is fed to a conventional timer 106, such as a one-shot multivibrator. The output of timer 106 is normally binary "0" but changes to "1" when AND gate 100 generates an output signal. The output of timer 106 remains equal to "1" for a specified duration $T_D$, such as 130 milliseconds. The output of timer 106 is applied to an inverter 108 and AND gate 104. Consequently, AND gate 98 is disabled and AND gate 104 is enabled during the timing interval $T_D$ of timer 106. If the signal from receiver 50 remains above the threshold level determined by threshold limiter 94, and maintains a negative slope longer than the interval $T_D$, AND gate 98 will generate an output signal corresponding to binary "1". The signature illustrated in FIG. 7(*a*) satisfies these criteria. It represents a conventional over the peak signature. FIG. 8 (*a*) illustrates the outputs of threshold limiters 94 and 96, timer 106, and AND gate 98 for this signature.

Figure 7A:
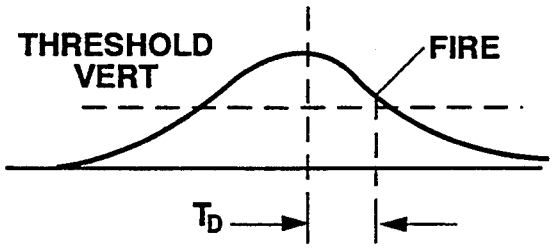
FIGS. 7(*a*)–(*c*) are curves of magnetic signatures received from a target.
Figure 7B:
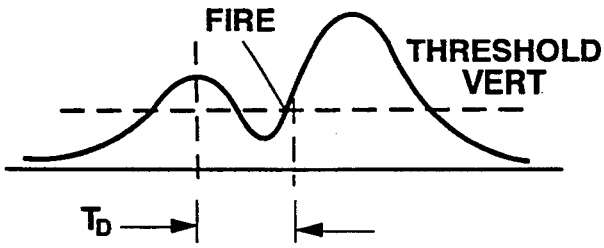
Figure 7C:
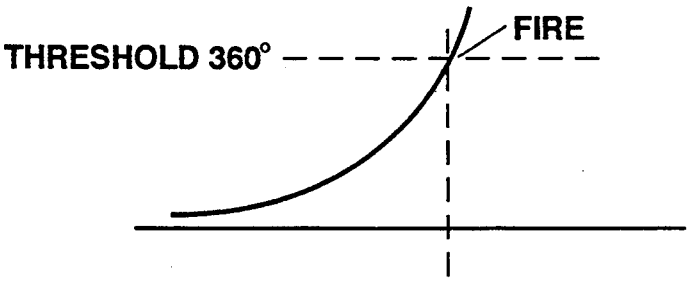
Figure 8A:
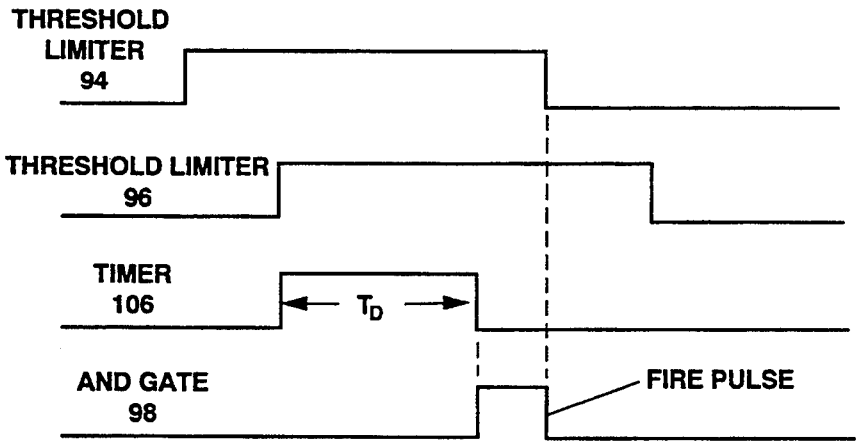
FIGS. 8(*a*)–(*c*) are timing diagrams for the outputs of the signal processor in response to the signature of FIGS. 7(*a*)–(*c*), respectively.
Figure 8B:
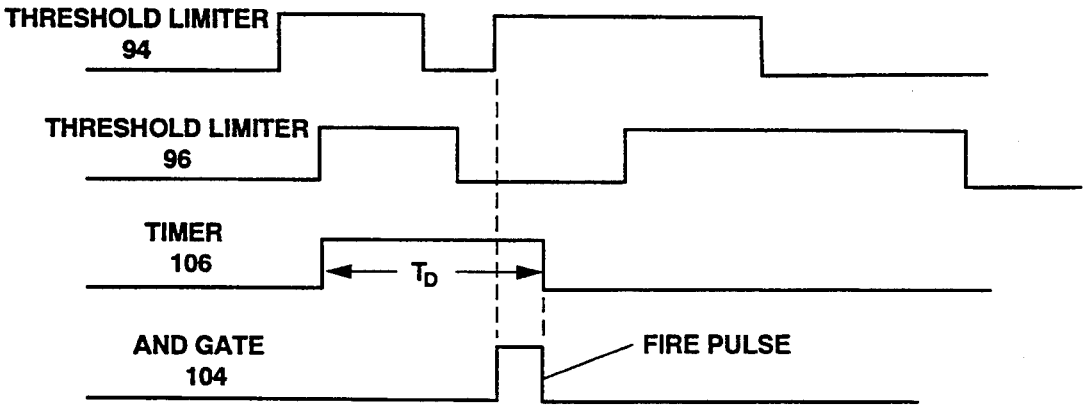
Figure 8C:
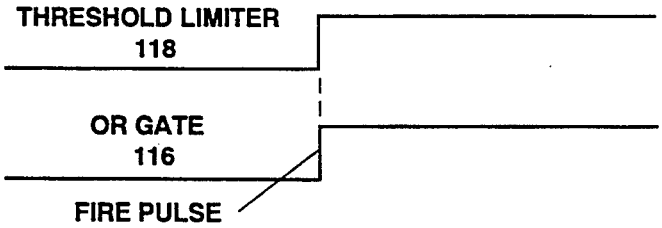

FIG. 7 (*b*) illustrates the type of signature needed to generate an output signal from AND gate 104. If the input signal from vertical receiver 50 satisfies the negative slope criterion of detector 92 and the threshold criterion of limiter 94, timer 106 is started, and AND gate 104 is enabled. If the slope of the signature then becomes positive, the output of inverter 102 will change to binary "1". If the input signal remains above the minimum amplitude threshold level established by threshold limiter 94 and retains its positive slope during the remainder of timing interval $T_D$, AND gate 104 will generate an output signal. This type of signature, known as a rail-to-rail signature, may be generated by some types of vessels. The timing diagram for the signature of FIG. 7(*b*) is illustrated in FIG. 8(*b*).

The outputs of AND gates 98 and 104 are applied to an 0R gate 110 and its output is applied to an AND gate 112. AND gate 112 is enabled by a surface ship mode signal applied through a terminal 114. The output of AND gate 112 is applied to an OR gate 116. Consequently, if signal processor 54 is in the surface ship mode, an output signal from either AND gate 98 or AND gate 104 will produce an output signal at OR gate 116 that is fed to exploder 24 for detonation of the charge.

The input signal from 360° receiver 52 is applied through terminal 90 to a conventional threshold limiter 118, having a much higher threshold level than threshold limiter 94. For example, the level of threshold limiter 94 may be only 0.8 volts, while the level for threshold limiter 118 may be 2.0 volts. The output of threshold limiter 118 is applied to OR gate 116. Consequently, the only requirement to produce detonation from 360° receiver 52 is that the signature reach a very high amplitude level. This type of signature, illustrated in FIG. 7(*c*) is generated when the torpedo is on a collision trajectory with the target, such as may occur when the target is a submarine. The timing diagram for this signature is illustrated in FIG. 8(*c*). It should be understood that exploder 24 may have numerous firing inputs, of which the output of OR gate 116 represents only the electromagnetic firing input. Other inputs may include impact, such as generated by piezoelectric sensors mounted on the surface of the torpedo, active acoustic, or laser, none of which are part of this invention.

Obviously, numerous modifications and variations of the present invention are possible in the light of the above teachings. For example, different coil configurations can be used to generate the desired directivity patterns. It is therefore to be understood that within the scope of the appended claims the invention may be practiced otherwise than as specifically described herein.

What is claimed as new and desired to be secured by Letters Patent of the United States is:

1. A warhead influence firing system comprising:

a warhead section;

a plurality of transmitter coils mounted on the surface of said warhead section for transmitting electromagnetic radiation;

a plurality of receiver coils mounted on the surface of said warhead section for receiving electromagnetic radiation generated by a target in response to the electromagnetic radiation of said transmitter coils;

first means for powering said transmitter coils; and second means for processing the output of said receiver coils to null out directly induced signals from said transmitter coils, and for generating a firing output signal in response to the electromagnetic radiation generated by said target.

2. The system of claim 1, wherein said transmitter coils and said receiver coils are mounted in recesses in the surface of said warhead section.

3. The system of claim 1, wherein said transmitter coils comprise at least four coils symmetrically positioned about said warhead section and electrically connected in parallel.

4. The system of claim 1, wherein said first means comprises:

means for receiving three phase power and converting it into regulated direct current power; and a transmitter for receiving said regulated direct current power and for generating a sinusoidal signal for said transmitter coils.

5. The system of claim 1, wherein said plurality of receiver coils comprises at least two pairs of receiver coils mounted symmetrically on said warhead section, each pair comprising a first coil and a second coil wound substantially orthogonally to each other, said first coils in each pair connected in series to form a first set of receiver coils, and said second coils in each pair connected in series to form a second set of receiver coils.

6. The system of claim 5, wherein said second means comprises:

first receiving means coupled to said first set of receiver coils and second receiving means coupled to said second set of receiver coils, each receiving means for nulling out directly induced electromagnetic radiation from said transmitter coils and for detecting a signature from said target; and signal processing means coupled to said first and said second receiving means for generating said firing output signal in response to said signature from either receiver.

7. The system of claim 6, wherein said signal processing means comprises:

slope detecting means for generating a signal whenever the time derivative of said voltage signature is of a specified polarity and above a specified minimum amplitude;

first threshold detecting means for generating a first output signal whenever the amplitude of said signature is above a first specified minimum amplitude;

second threshold detecting means for generating an output signal whenever the amplitude of said signature is above a second specified minimum amplitude; and gating means for generating said firing output signal whenever the output signal of said slope detecting means and said first threshold detecting means satisfy specified time duration criteria, and for generating said firing output signal in response to the output of said second threshold detecting means.

8. A method for detecting metallic targets and firing an explosive charge, comprising the steps;

transmitting electromagnetic radiation;

receiving a portion of the transmitted electromagnetic radiation; receiving electromagnetic radiation produced by eddy currents in the metallic target in response to the transmitted electromagnetic radiation;

subtracting out said portion of said transmitted electromagnetic radiation and detecting the electromagnetic radiation produced by said eddy currents in said target;

detecting the signature of said detected electromagnetic radiation from said target; and generating a firing output signal whenever said detected signature satisfies specified amplitude and time derivative criteria.

* * * * *